US009433295B2

(12) United States Patent
Crum

(10) Patent No.: US 9,433,295 B2
(45) Date of Patent: Sep. 6, 2016

(54) ZEROWALL MOTORIZED MULTI-POSITION RECLINER CHAIR MECHANISM

(71) Applicant: Michael A. Crum, Mantachie, MS (US)

(72) Inventor: Michael A. Crum, Mantachie, MS (US)

( * ) Notice: Subject to any disclaimer, the term of this patent is extended or adjusted under 35 U.S.C. 154(b) by 0 days.

(21) Appl. No.: 14/514,554

(22) Filed: Oct. 15, 2014

(65) Prior Publication Data

US 2016/0106215 A1 Apr. 21, 2016

(51) Int. Cl.

| | |
|---|---|
| ***A47C 1/031*** | (2006.01) |
| ***A47C 1/034*** | (2006.01) |
| *A47C 1/032* | (2006.01) |
| *A47C 7/40* | (2006.01) |
| *A47C 7/38* | (2006.01) |
| *A47C 3/025* | (2006.01) |
| *A47C 1/035* | (2006.01) |
| *A47C 7/50* | (2006.01) |

(52) U.S. Cl.

CPC ..... *A47C 1/0342* (2013.01); *A47C 1/035* (2013.01); *A47C 1/03211* (2013.01); *A47C 3/0255* (2013.01); *A47C 7/38* (2013.01); *A47C 7/40* (2013.01); *A47C 7/506* (2013.01)

(58) Field of Classification Search

CPC .... A47C 7/38; A47C 3/0255; A47C 1/0342; A47C 7/40; A47C 7/506; A47C 1/03211; A47C 1/035

USPC ..... 297/68, 342, 463.1, 354.12, 85 M, 85 R, 297/84

See application file for complete search history.

(56) References Cited

U.S. PATENT DOCUMENTS

| | | | | |
|---|---|---|---|---|
| 4,108,491 A | | 8/1978 | Rogers, Jr. | |
| 4,418,957 A | | 12/1983 | Rogers, Jr. | |
| 5,480,209 A | | 1/1996 | May | |
| 5,588,710 A | | 12/1996 | Wiecek | |
| 5,730,494 A | * | 3/1998 | LaPointe | A61G 5/14 297/330 |
| 5,845,961 A | * | 12/1998 | LaPointe | A47C 1/0345 297/423.36 |
| 5,992,931 A | * | 11/1999 | LaPointe | A47C 1/0345 297/330 |
| 6,000,758 A | * | 12/1999 | Schaffner | A47C 1/0345 297/180.12 |
| 6,659,556 B2 | | 12/2003 | Pellerin | |
| 6,729,686 B2 | | 5/2004 | May | |
| 7,396,074 B2 | | 7/2008 | Wiecek | |
| 7,850,232 B2 | | 12/2010 | Casteel | |
| 7,997,644 B2 | | 8/2011 | Hoffman et al. | |
| 8,113,574 B2 | | 2/2012 | Hoffman et al. | |
| 8,398,165 B2 | | 3/2013 | Lawson | |
| 8,398,168 B2 | | 3/2013 | Lawson | |
| 8,459,733 B2 | | 6/2013 | Hoffman et al. | |
| 8,573,687 B2 | | 11/2013 | Lawson et al. | |
| 2001/0035668 A1 | * | 11/2001 | Gaffney | A47C 1/0345 297/85 M |

(Continued)

*Primary Examiner* — Chi Q Nguyen

(74) *Attorney, Agent, or Firm* — Law Offices of Steven W. Weinrieb

(57) ABSTRACT

A zerowall motorized multi-position recliner chair mechanism is disclosed wherein, in accordance with a first embodiment, the chair seat rails are stably supported by means of a pair of oppositely disposed support linkage systems connected to the chair base rails. In addition, the rear sections of the pair of oppositely disposed support linkage systems are pivotally connected to the base rails at first pivot points, while the drive motor is pivotally mounted upon an integral structural unit so as to permit the drive motor to pivot around a second pivot point which is coaxially disposed with respect to the first pivot point. In this manner, the drive motor is substantially fixed, or at least positionally constrained, at a predetermined position with respect to the base rails, thereby providing additional stability to the chair. In accordance with a second embodiment, the drive motor is attached directly to the rear base rail.

20 Claims, 5 Drawing Sheets

(56) References Cited

U.S. PATENT DOCUMENTS

2003/0047973 A1 3/2003 Pellerin
2011/0018331 A1* 1/2011 Murphy ..... A47C 1/0355 297/85 R
2011/0304193 A1* 12/2011 Murphy ..... A47C 1/034 297/85 M
2012/0153704 A1 6/2012 Hoffman et al.
2012/0286557 A1 11/2012 Hoffman et al.
2012/0299363 A1* 11/2012 Crum ..... A47C 1/0355 297/85 M
2013/0038095 A1 2/2013 Lawson et al.
2014/0076891 A1* 3/2014 Taillefer ..... B65D 88/08 220/4.28
2014/0292052 A1* 10/2014 Parker ..... A47C 7/38 297/342
2015/0054316 A1* 2/2015 Donovan ..... A47C 1/032 297/76
2015/0076883 A1 3/2015 LaPointe
2015/0076891 A1* 3/2015 LaPointe ..... A47C 31/008 297/85 M
2015/0208805 A1* 7/2015 Griggs, Jr. ..... A47C 1/03222 297/463.1

* cited by examiner

ZEROWALL MOTORIZED MULTI-POSITION RECLINER CHAIR MECHANISM

STATEMENT REGARDING FEDERALLY SPONSORED RESEARCH OR DEVELOPMENT

Not Applicable

NAMES OF PARTIES TO JOINT RESEARCH AGREEMENT

Not Applicable

INCORPORATION BY REFERENCE OF MATERIAL SUBMITTED ON A COMPACT DISC

Not Applicable

FIELD OF THE INVENTION

The present invention relates generally to multi-position recliner chairs, and more particularly to a motorized multi-position recliner chair mechanism wherein when the chair is moved from its original closed or upright position to a fully open reclined position, the entire body of the chair is moved forwardly such that the chair can be disposed close to a wall with minimum spacing required to be defined therebetween.

BACKGROUND OF THE INVENTION

Furniture conventionally known as "zerowall" furniture are those artides of furniture, such as, for example, recliner chairs, wherein the rear portion of the chair can be disposed close to a wall of a room such that when the chair is to be moved from its original or normal closed or upright position, to its fully open reclined position, the entire body of the chair is moved forwardly so as to permit the seat back and the headrest portion of the chair to be inclined without coming into contact with, and thereby being obstructed in their movements from their original or normal closed or upright positions to their fully open reclined positions, by the wall. Earlier zerowall chairs were manually operated, however, motorized zerowall chairs were soon developed after the initial appearance of the manually operated chairs. Nevertheless, such motorized zerowall chairs encountered operational difficulties wherein, for example, substantially large forces, stresses, and torques were effectively impressed upon the drive motor components. In addition, the drive motors effectively moved significantly relative to the base rails, supporting the chairs upon the ground or other support surfaces, such that when the chairs were moved from their original or normal, closed or upright positions to their fully open reclined positions, the chairs did not comprise properly stabilized structures due to the aforenoted significant movements of the drive motors relative to the base rails. Still further, the drive systems, defined between the drive motor and the components of the chair that had to be moved in order to facilitate the movement of the chairs from their original or normal closed or upright positions to their fully open reclined positions, comprised relatively complex linkage arrangements.

A need therefore exists in the art for a new and improved zerowall motorized multi-position recliner chair mechanism wherein the disposition and connection of the drive motor relative to the base rails as well as to the actuating linkage components is such that substantially large forces, stresses, and torques are effectively eliminated from being impressed upon the drive motor components. A need also exists in the art for a new and improved zerowall motorized multi-position recliner chair mechanism such that the drive motor is effectively substantially positionally fixed pr constrained relative to the base rails, which support the chair upon the ground or other support surface, whereby when the chair is moved from its original or normal, closed or upright position to its fully open reclined position, the chair comprises a properly stabilized structure due to the substantially positionally fixed or constrained disposition of the drive motor relative to the base rails. Still further, a need exists in the art for a new and improved zerowall motorized multi-position recliner chair mechanism which comprises a relatively simplified linkage system that is defined between the drive motor and the components of the chair that need to be moved in order to facilitate the movement of the chair from its original or normal, closed or upright position to its fully open reclined position.

SUMMARY OF THE INVENTION

The foregoing and other objectives are achieved in accordance with the teachings and principles of the present invention through the provision of a new and improved zerowall motorized multi-position recliner chair mechanism wherein, in accordance with a first embodiment, the chair seat rails are stably supported by means of a pair of oppositely disposed support linkage systems connected to the chair base rails. In addition, the rear sections of the pair of oppositely disposed support linkage systems are pivotally connected to the base rails at first pivot points, while the drive motor is pivotally mounted upon an integral structural unit so as to permit the drive motor to pivot around a second pivot point which is coaxially disposed with respect to the first pivot point. In this manner, the drive motor is substantially fixed, or at least positionally constrained, at a predetermined position with respect to the base rails, thereby providing additional stability to the chair. In accordance with a second embodiment of the chair, the drive motor is attached directly to the rear base rail.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
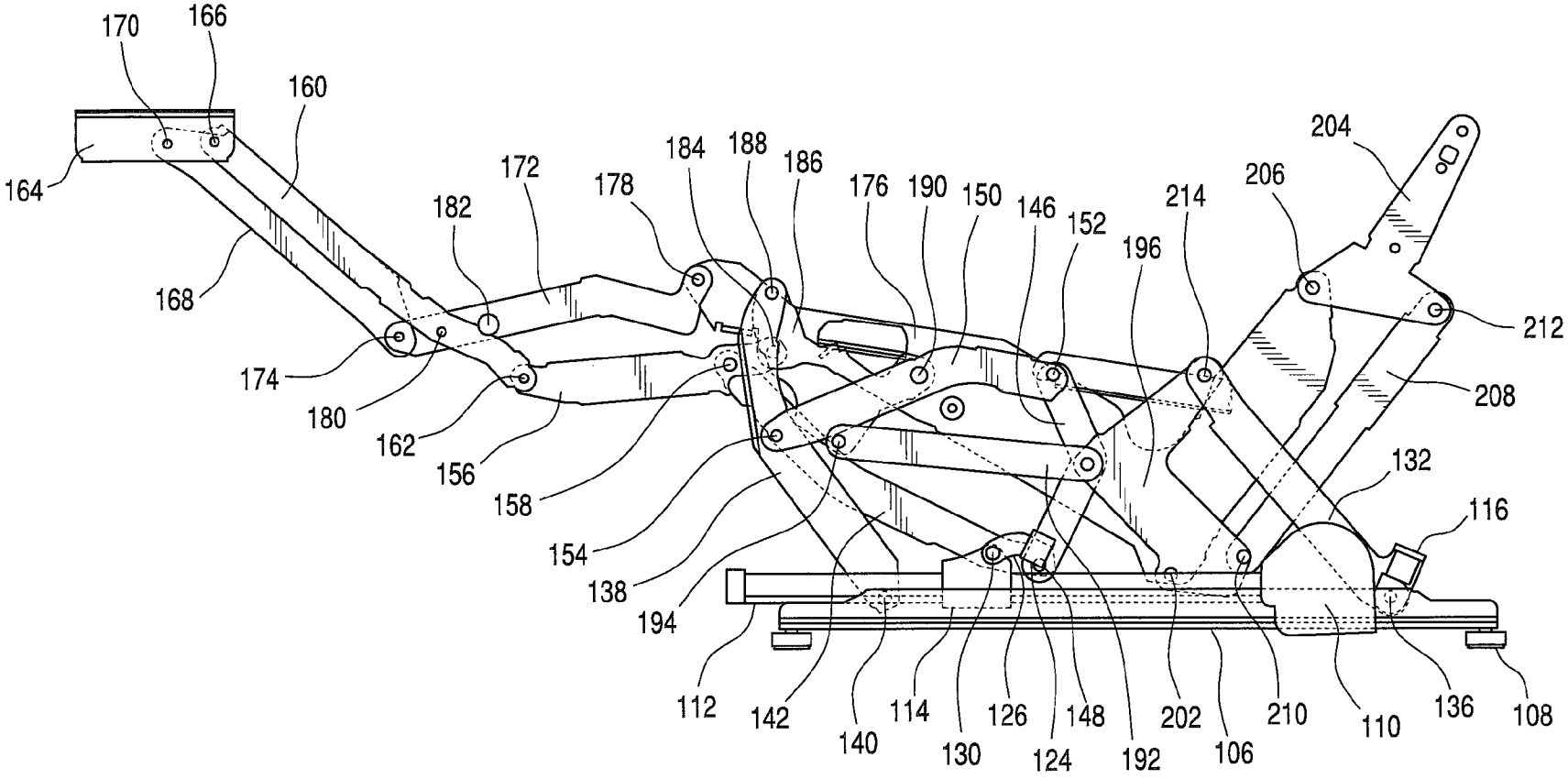
FIG. 2 is a schematic side elevational view, similar to that of FIGURE 1, showing, however, the zerowall motorized multi-position recliner chair wherein the chair is disposed at a partially open position at which, for example, the footrest has been moved to an extended position, however, the backrest is still disposed in an upright position.
Figure 3:
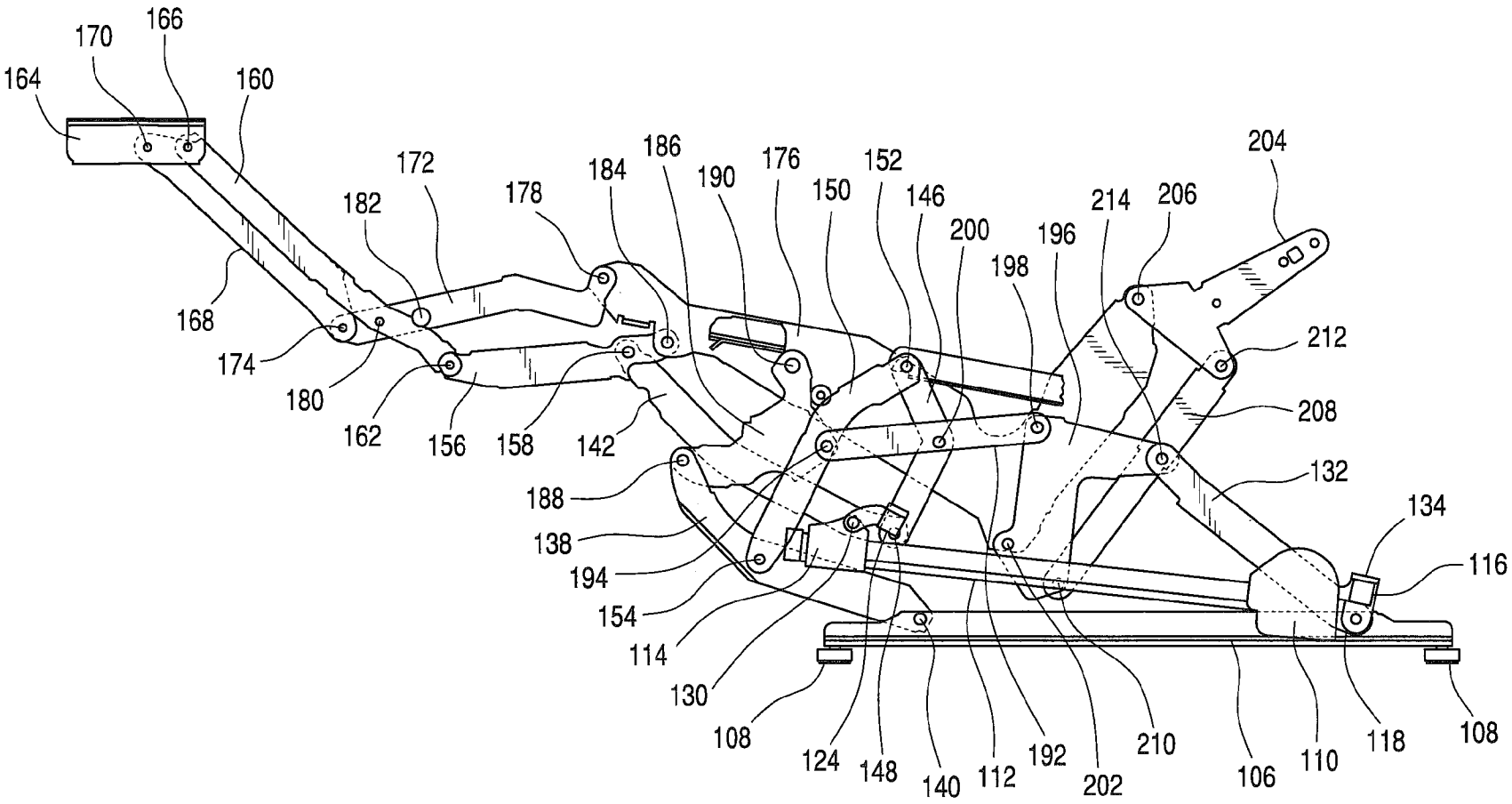
FIG. 3 is a schematic side elevational view, similar to that of FIGS. 1 and 2, showing, however, the zerowall motorized multi-position recliner chair wherein the chair is disposed at a completely open position at which the footrest has been moved to an extended position and the backrest has been disposed at a reclined position.
Figure 4:
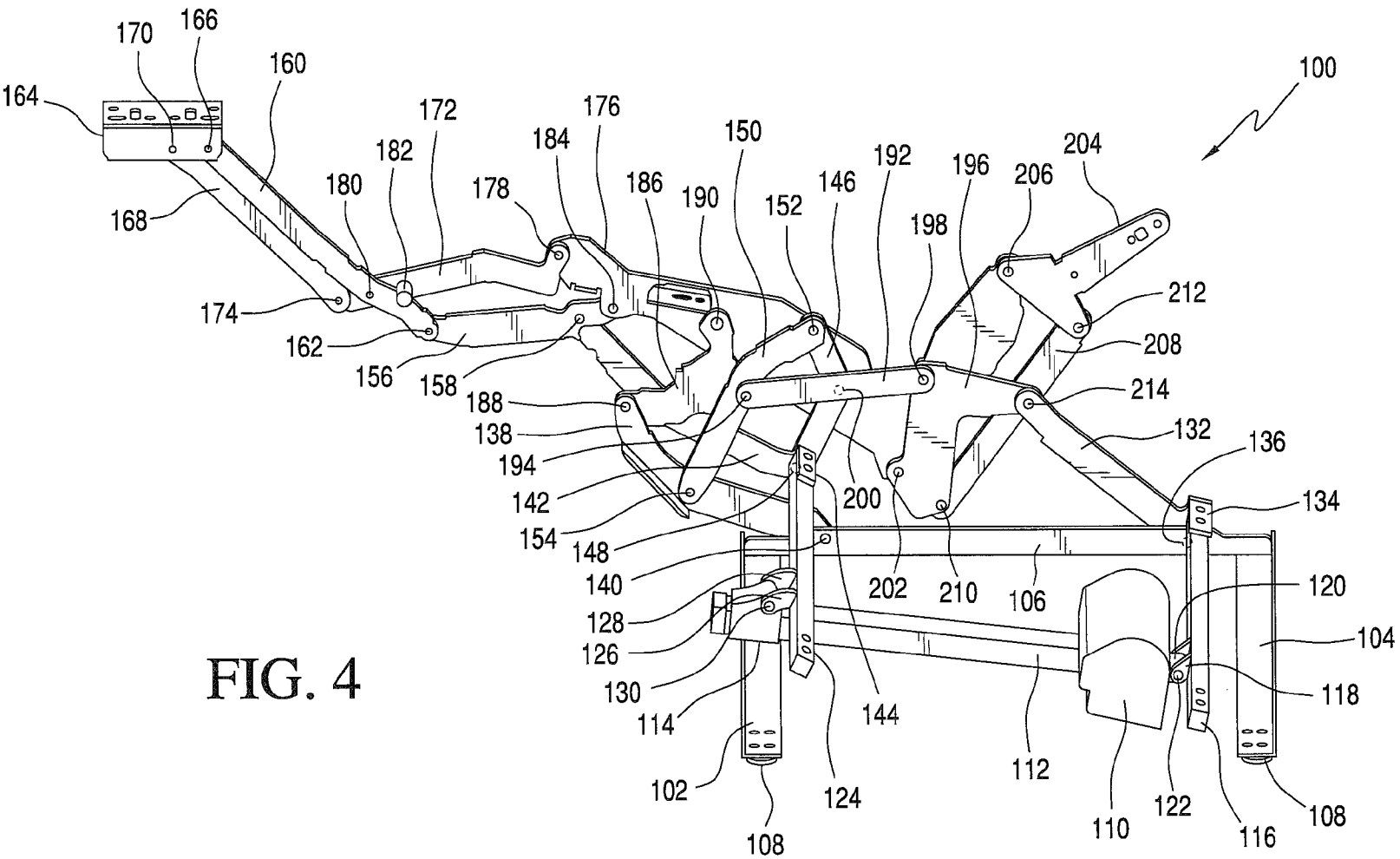
FIG. 4 is a perspective elevational view similar to that of FIG. 3 showing the various components of the zerowall motorized multi-position recliner chair at their respective positions as illustrated within FIG. 3.

Referring now to the drawings, and more particularly to FIGS. 1-4 thereof, a new and improved zerowall motorized multi-position recliner chair mechanism is disclosed and is generally indicated by the reference character 100. As was noted in the BRIEF DESCRIPTION OF THE DRAWINGS, FIG. 4 is a perspective view of only, for example, the right half side of the chair mechanism 100, it therefore being understood and noted further that an opposite mirror image of the chair mechanism components illustrated within FIG. 4 would comprise the left half side of the chair mechanism 100 so as to in fact comprise the entire operative chair mechanism 100. As can be best seen from FIG. 4, the new and improved zerowall motorized multi-position recliner chair mechanism 100 is seen to comprise four base rails, only three of which are illustrated at 102,104,106, wherein the four base rails 102 are disposed within a substantially rectangular array and are stably supported upon a ground or floor surface, not shown, by means of downwardly projecting feet or leg members 108. For convenience, the three visible base rails 102,104,106 will be referred to hereinafter as the forward base rail member 102, the rearward base rail member 104, and the right side base rail member 106. In addition, it is further seen that the chair mechanism 100 comprises a drive motor 110 which has a drive or linear motor actuator 112 operatively associated therewith. The drive or linear motor actuator 112 can comprise a cylindrical screw having rotary threads formed thereon so as to operatively cooperate and drive an actuator drive block 114 forwardly and rearwardly along the actuator 112 as the drive motor 110 rotates the drive motor actuator 112, the actuator drive block 114 of course having cooperating threads disposed internally thereof. Other linear actuators, such as, for example, the linear actuator disclosed within U.S. Pat. No. 8,398,165 which issued to Lawson on Mar. 19, 2013, as well as the linear actuator disclosed within U.S. Pat. No. 8,573,687 which issued to Lawson et al. on Nov. 5, 2013, can likewise be utilized. It is further seen that the drive motor 110 is pivotally mounted upon, and connected to, a transversely oriented rear motor mounting tube 116 by means of a clevis-type rear motor mounting bracket 118, wherein a lug 120 projects outwardly from the drive motor 110 and is pivotally connected to the mounting bracket 118 by means of a pivot pin connection 122. In a similar manner, it is likewise seen that the actuator drive block 114 is pivotally mounted upon, and connected to, a transversely oriented front actuator drive block mounting tube 124 by means of a clevis-type front actuator drive block mounting bracket 126, wherein a lug 128 projects outwardly from an upper surface portion of the actuator drive block 114 and is pivotally connected to the mounting bracket 126 by means of a pivot pin connection 130.

With reference continuing to be made to FIG. 4, it is further seen that the right end portion of the transversely oriented rear motor mounting tube 116 is fixedly connected to a right rear support link 132 by means of a corner mounting bracket 134, it of course being appreciated and understood that the left end, not illustrated, of the rear mount tube 116 is likewise fixedly connected to a corresponding, oppositely disposed rear support link, also not illustrated. In this manner, a first integrally fixed unit is effectively formed by means of the rear motor mounting bracket 118, the rear motor mount tube 116, and the right rear support link 132. The right rear support link 132 is, in turn, pivotally connected at the lower end portion thereof to the right side base rail member 106 by means of a pivot pin 136, which can best be seen in FIGS. 1-3, and it is to be understood and appreciated further that the pivot pins 122 and 136 are coaxially disposed with respect to each other. In this manner, or as a result of this construction of this portion of the chair mechanism 100, it can be appreciated that the drive motor 110 is effectively positionally fixed, or at least positionally constrained, with respect to the base rail assembly comprising the base rail members 102,104,106, such that the drive motor 110 does not undergo any significant positional movement relative to the base rail assembly other than some pivotal movement as permitted by means of the pivot pin assembly 118,120,122 as will be necessary when the various components of the chair mechanism linkage system are actuated, as will be more fully explained hereinafter. Furthermore, this structural relationship prevents any asymmetrical moments from being developed when the drive motor 110 undergoes any pivotal movements whereby, otherwise, such asymmetrical moments would act upon or be transferred to the various linkage components and the base rails 102,104,106 possibly rendering the chair mechanism 100 unstable. Accordingly, this positional constraint and limited movement of the drive motor 110 with respect to the base assembly provides enhanced stability for the recliner chair.

In a similar manner, and as will also be more fully discussed hereinafter, chair mechanism 100 likewise comprises a right front support link 138 wherein the lower end portion of the right front support link 138 is pivotally connected to the right side base rail member 106 by means of a pivot pin 140 which can best be seen in FIGS. 1-3. Still yet further, and in a manner similar to the fixed connection that was defined between the rear support link 132 and the rear motor mounting tube 116 by means of the corner bracket 134, it is likewise seen that the lower end portion of a first drive control link 142 is fixedly connected to the right end portion of the front actuator drive block mounting tube 124 by means of a corner mounting bracket 144. In this manner, a second integrally fixed unit is effectively formed by means of the front actuator drive block mounting bracket 126, the front actuator drive block mounting tube 116, and the right rear support link 132. In addition, it is also seen that the lower end portion of a pivot link 146 is pivotally connected to the lower end portion of the first drive control link 142 by means of a pivot pin 148 which can best be seen in FIGS. 1-3. In turn, the upper end portion of the pivot link 146 is pivotally connected to a first end portion of a second drive control link 150 by means of a pivot pin 152, while a second opposite end portion of the second drive control link 150 is pivotally connected to an intermediate section of the right side front support link 138 by means of a pivot pin 154.

It will also be seen that the upper end portion of the drive control link 142 is pivotally connected to an inter-mediate portion of a first footrest actuating link 156 by means of a pivot pin 158, while a first end portion of the first footrest actuating link 156 is pivotally connected to a first end portion of a second footrest actuating link 160 by means of a pivot pin 162. The second opposite end portion of the second footrest actuating link 160 is pivotally connected to a rear portion of a footrest mounting bracket 164 by means of a pivot pin 166, while it is additionally seen that a first end portion of a third footrest actuating link 168 is pivotally attached to an intermediate portion of the footrest mounting bracket 164 by means of a pivot pin 170. The second opposite end portion of the third footrest actuating link 168 is seen to be pivotally connected to a first end portion of a fourth footrest actuating link 172 by means of a pivot pin 174, and the second opposite end portion of the fourth footrest actuating link 172 is pivotally connected to a right side seat rail 176 by means of a pivot pin 178. It is also noted that an intermediate portion of the fourth footrest actuating link 172 is pivotally connected to an intermediate portion of the second footrest actuating link 160 by means of a pivot pin 180, for a purpose that will be discussed more fully hereinafter, and it is also seen that the fourth footrest actuating link 172 is also provided with a contact stop 182 for a purpose which will likewise be discussed more fully hereinafter. Lastly, with respect to the footrest actuating links 156,160,168, and 172, it is seen that a second opposite end portion of the first footrest actuating link 156 is pivotally connected to the right side seat rail 176 by means of a pivot pin 184.

Continuing further, it is seen that the upper end portion of the right side front support link 138 is pivotally connected to a first corner region of a substantially triangular-shaped recline control link 186 by means of a first pivot pin 188, while a second corner region of the recline control link 186 is pivotally connected to the seat rail 176 by means of a second pivot pin 190. Still yet further, a third corner region of the recline control link 186 is pivotally connected to a first end portion of a recline connector link 192 by means of a third pivot pin 194, while a second opposite end portion of the recline connector link 192 is pivotally connected to a first region of a recline pivot link 196, which has a substantially inverted L-shaped configuration, by means of a first pivot pin 198. Within this region of the mechanism linkage system, it can also be seen that an intermediate portion of pivot link 146 is pivotally connected to a substantially central portion of the seat rail 176 by means of a pivot pin 200 which can best be seen in FIG. 3. Reverting back to the substantially inverted L-shaped recline pivot link 196, it is further seen that a first lower portion of the recline pivot link 196 is pivotally connected to a lower portion of the seat rail 176 by means of a second pivot pin 202, while an upper rear portion of the seat rail 176 has a first corner portion of a seatback support or mounting bracket 204 pivotally mounted thereon by means of a pivot pin 206. A second lower portion of the recline pivot link 196 has a first lower end portion of a backrest recline link 208 pivotally connected thereto by means of a third pivot pin 210, while the second opposite upper end portion of the seatback recline link 208 is pivotally connected to the seatback support or mounting bracket 204 by means of a pivot pin 212. It is lastly seen that an upper end portion of the right rear support link 132 is pivotally connected to the outwardly projecting portion of the substantially inverted L-shaped recline pivot link 196 by means of a fourth pivot pin 214.

Having now described substantially all of the operating components defining the recliner chair mechanism 100, a brief operation of the same, for quickly and smoothly moving the various components comprising the recliner chair, such as, for example, the footrest mounting bracket 164, upon which a chair footrest, not shown, will be mounted, as well as the backrest support or mounting bracket 204, upon which a chair backrest, also not shown, will likewise be mounted, between their CLOSED or retracted positions to their fully OPEN or extended positions, will now be described. It will be seen that the linkage system of the present invention mechanism will, in effect, comprise a first linkage system which moves the footrest from a CLOSED position to an OPEN position as a result of the linear movement of the actuator drive block from its original START position to a first predetermined position along the drive motor actuator, and a second linkage system which moves the seatback from an upright position to an inclined position as a result of the linear movement of the actuator drive block still further along the drive motor actuator from the first predetermined position to the second predetermined position. More particularly, with reference being made to FIG. 1, the new and improved zerowall motorized multi-position recliner chair mechanism 100 is disclosed at its retracted or CLOSED position at which it can be seen that the drive motor 110 has been actuated such that the actuator drive block 114 is disposed at its rearward-most position. Accordingly, the footrest mounting bracket 164 is disposed at its CLOSED position at which a footrest, not shown, mounted upon the footrest mounting bracket 164, will be disposed at its CLOSED position at which the footrest will be disposed in a vertically downward orientation, while the backrest support or mounting bracket 204 will be disposed at its upright position. When it is desired to initially move the chair from its original, normally CLOSED position to, for example, a TV position at which the footrest is moved from its vertically downward position to an elevated position as disclosed within FIG. 2, the motor drive 106 is actuated so as to move the actuator drive block 114 forwardly with respect to the drive motor actuator 112 to, for example, the disposition of the actuator drive block 114 as illustrated within FIG. 2. Accordingly, it can be seen that as the actuator drive block 114 moves forwardly along the drive motor actuator 112, the first drive control link 142 is correspondingly moved forwardly as a result of the first fixed integral unit defined by or between the actuator drive block 114, the actuator drive block lug 128, the front motor mounting bracket 126, the front actuator drive block mounting tube 124, and the first drive control link 142 fixedly secured to the front actuator drive block mounting tube 124 by means of the corner bracket 144. Still further, appreciating the fact that the forward end portion of first drive control link 142 is pivotally connected to the first footrest actuating link 156, the first footrest actuating link 156 will move in a clockwise direction from its position illustrated within FIG. 1 to its position illustrated within FIG. 2 as a result of pivotal movement around pivot pin 184 which pivotally secures the first drive control link 142 to the seat rail 176. In turn, the second footrest actuating link 160 is moved forwardly or extended from its position illustrated within FIG. 1 to its position illustrated within FIG. 2 as a result of its pivotal connection, at its first end portion, to the first footrest actuating link 156 by means of pivot pin 162.

Recalling that the second opposite end portion of the second footrest actuating link 160 is pivotally connected to the footrest mounting bracket 164 by means of pivot pin 166, the footrest mounting bracket 164 is moved toward its forward-most elevated and horizontally oriented disposition as a result of the pivotal connection defined between the footrest mounting bracket 164 and the third footrest actuating link 168. It will also be recalled that an intermediate portion of the second footrest actuating link 160 is pivotally connected to the fourth footrest actuating link 172 which is not only pivotally connected at one end portion thereof to the seat rail 176 by means of pivot pin 178, but the fourth footrest actuating link 172 is also pivotally attached at its opposite end portion to the third footrest actuating link 168 by means of pivot pin 174. Accordingly, as the fourth footrest actuating link 172 is moved forwardly as a result of the forward movement of the second footrest actuating link 160, the fourth footrest actuating link 172 will effectively cause the third footrest actuating link 168 to move upwardly, thereby moving the footrest support bracket 164 to a horizontal orientation and to a predetermined elevational position relative to the base rails 102,104,106. This orientation is also effectively predetermined as a result of the predetermined spacing defined between the pivot pins 166 and 170. Still yet further, this actuating movement of the various linkage components continues until the stop member 182, disposed upon the fourth footrest actuating link 174, encounters the second footrest actuating link 160. As the footrest support bracket 164 is moving forwardly relative to the base rails 102,104, 106 by means of the aforenoted linkage connections, the seat rail 176 is also being moved forwardly so as to achieve the desired zerowall functional operation of the recliner chair.

Figure 1:
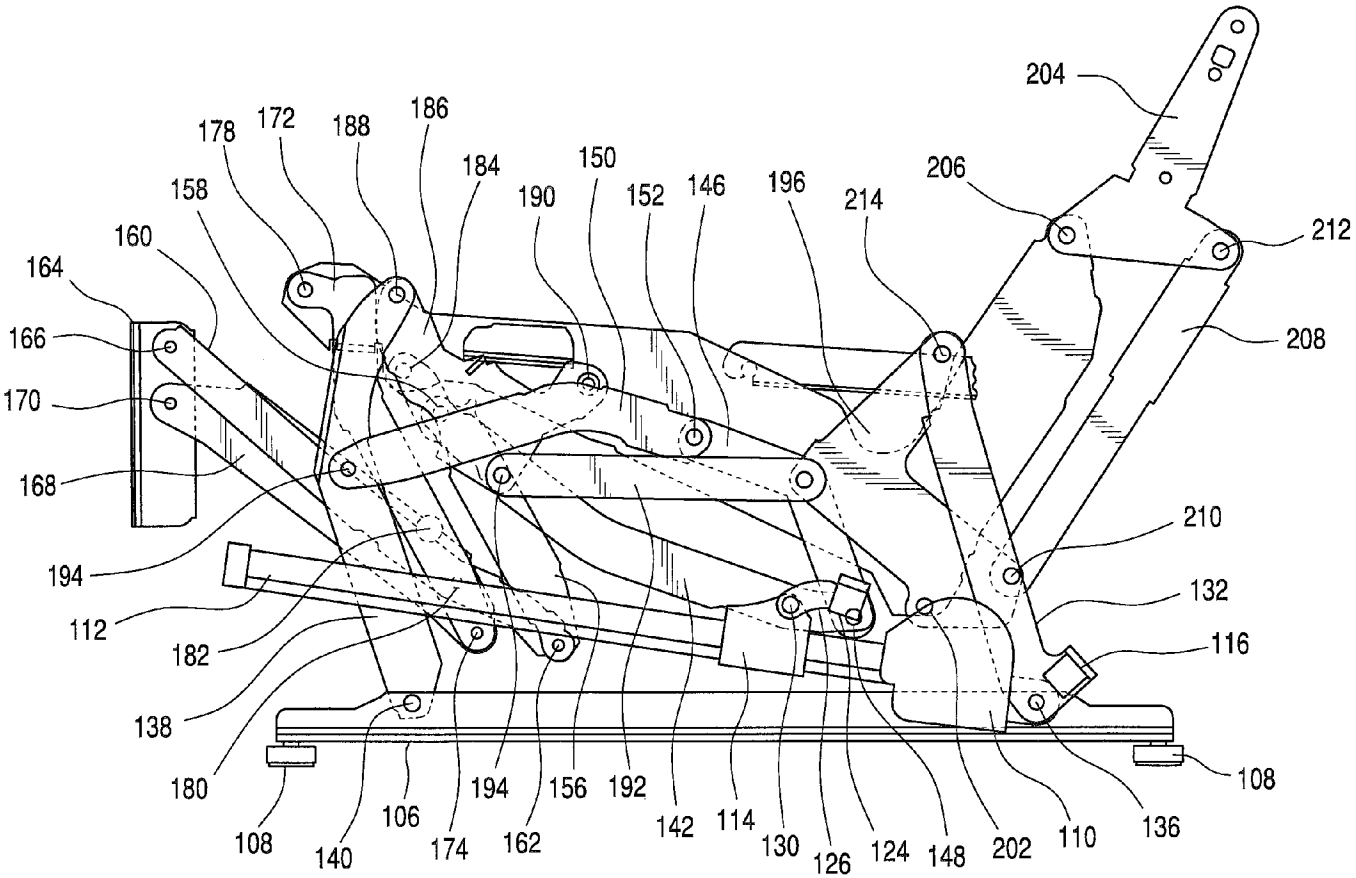
FIG. 1 is a schematic side elevational view of the right side half of a first embodiment of a new and improved zerowall motorized multi-position recliner chair mechanism as developed in accordance with the principles and teachings of the present invention wherein the chair is disposed at its normally closed, original, upright position.

More particularly, it will be recalled that the pivot link 146 is pivotally connected to the first drive control link 142 by means of the pivot pin 148 which can best be seen in FIG. 1. In addition, it will also be recalled that the pivot link 146 is pivot-ally connected to the seat rail 176 by means of the pivot pin 200. Accordingly, as the first drive control link 142 is moved forwardly, the seat rail 176 will be moved forwardly as a result of its pivotal connection to the pivot link 146 which, in turn, is pivotally connected at its lower end portion to the first control drive link 142 as at 148, however, the pivot link 146 will also pivot or rotate in the clockwise direction around pivot pin 200, pivotally connecting the pivot link 146 to the seat rail 176, causing the second control drive link 150 to rotate in a clockwise direction. Since the upper end portion of the pivot link 146 is also pivotally connected to one end portion of the second drive control link 150 by means of pivot pin 152, while the second opposite end portion of the second drive control link 150 is pivotally connected to an intermediate portion of the right side front support link 138 by means of pivot pin 154, it can therefore be appreciated that the right side front support link 150 effectively moves in a counterclockwise direction with respect to the base rails 102,104,106. It is to be noted that the chair mechanism 100 is supported by means of the front support links 138, only the right side front support link 138 being illustrated, as well as by means of the rear support links 132, only the right side rear support link 132 being illustrated.

When the recliner chair is moved from the TV position illustrated within FIG. 2, to the fully reclined position illustrated within FIG. 3, and therefore with reference now being made to FIG. 3, it is noted that the actuator drive block 114 has now been moved to its forwardmost position. Accordingly, the right side support link 138 has been rotated still further in the counterclockwise direction, and therefore it is seen that such rotation of the right side support link 138 causes the counterclockwise rotation of the recline control link 186 relative to the seat rail 176 as a result of the pivotal connection of the recline control link 186 to the seat rail 176 by means of the pivot pin 190. It will be recalled that one end portion, that is, the left end portion, of the recline connector link 192 is pivotally connected to the recline control link 186, while the opposite or right end portion of the recline connector link 192 is pivotally connected to the recline pivot link 196. Therefore, as the recline control link 186 rotates or pivots in a counterclockwise direction, the recline connector link 192 will effectively be moved toward the right or rearwardly. Such rightward or rearward movement of the recline connector link 192 will, in turn, cause clockwise rotation of the recline pivot link 196 around pivot pin 202 that pivotally connects the recline pivot link 196 to the seat rail 176. Rotational movement of the recline pivot link 196, in turn, results in the downward movement of the backrest recline link 208 as a result of the pivotal connection of the lower end portion of the backrest recline link 208 to the recline pivot link 196 by means of pivot pin 210. The downward movement of the backrest recline link 208 therefore causes the seatback support or mounting bracket 204 to be rotated in a clockwise direction relative to the seat rail 176, around pivot pin 206, as a result of the pivotal connection defined between the seatback recline link 208 and the seatback support or mounting bracket 204 by means of pivot pin 212. It is to be lastly understood that the driving of drive motor 110 in a reverse mode will effectively reverse all of the aforenoted movements of the various mechanism linkages such that the chair mechanism 100 can be moved and returned from its fully recline position, illustrated within FIGS. 3 and 4, to the intermediate and original positions respectively illustrated within FIGS. 2 and 1.

Figure 5:
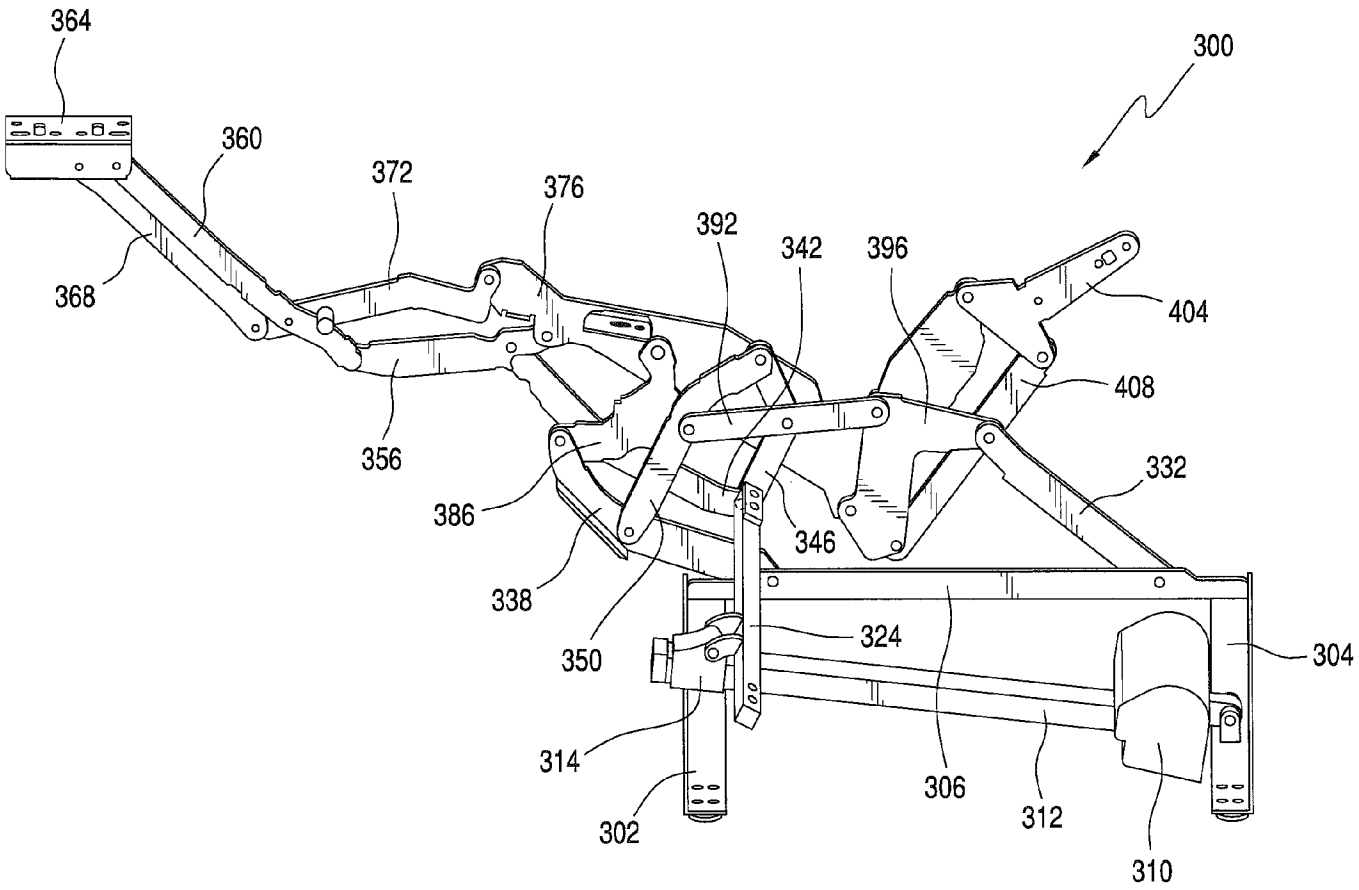
FIG. 5 is a perspective elevational view similar to that of FIG. 4 showing the various components of a second embodiment of the zerowall motorized multi-position recliner chair with the various components disposed at their respective positions as illustrated within FIG. 4.

Lastly, with reference now being made to FIG. 5, a second embodiment of a new and improved zerowall motorized multi-position recliner chair mechanism is disclosed and is generally indicated by the reference character 300. It is to be noted that component parts of the second embodiment chair mechanism illustrated within FIG. 5, that correspond to component parts of the first embodiment chair mechanism illustrated within FIG. 1, will be denoted by similar reference characters except that such reference characters will be in the 300 and 400 series. In addition, for brevity purposes, a description of those structural components which are common to both embodiments, and which are operationally similar, will not be discussed in detail, the description of the second embodiment illustrated within FIG. 5 being limited to the structural differences between the first and second embodiments. More particularly, it can readily be seen that the primary difference of the chair mechanism 300 as illustrated within FIG. 5, when compared to the chair mechanism 100 disclosed within FIGS. 1-4, resides in the fact that the rear motor mounting tube has effectively been eliminated. As a result of this structural change, it is seen that in lieu of the drive motor 310 of the chair mechanism 300 being mounted upon the rear motor mounting tube, the drive motor 310 is pivotally attached directly to the rear base or floor rail 304. In addition, it is likewise seen that the right rear support link 332 is likewise connected directly to the right base rail 306.

Thus, it may be seen that, in accordance with the teachings and principles of the present invention, there has been disclosed a zerowall motorized multi-position recliner chair mechanism wherein, in a first embodiment, the chair seat rails are stably supported by means of a pair of oppositely disposed support linkage systems connected to the chair base rails. In addition, the rear sections of the pair of oppositely disposed support linkage systems are pivotally connected to the base rails at first pivot points, while the drive motor is pivotally mounted upon an integral structural unit so as to permit the drive motor to pivot around a second pivot point which is coaxially disposed with respect to the first pivot point. In this manner, the drive motor is substantially fixed, or at least positionally constrained, at a predetermined position with respect to the base rails, thereby providing additional stability to the chair. In accordance with a second embodiment, the drive motor is attached directly to the rear base rail.

Obviously, many variations and modifications of the present invention are possible in light of the above teachings. It is therefore to be understood that within the scope of the appended claims, the present invention may be practiced otherwise than as specifically described herein.

NUMBER KEY GUIDE TO COMPONENT PARTS

100—chair mechanism
102—front base rail member
104—rear base rail member
106—right side base rail member
108—feet/legs
110—drive motor
112—drive motor actuator
114—actuator drive block
116—rear motor mounting tube
118—rear motor mounting bracket
120—lug of drive motor
122—pivot pin pivotally connecting 120 to 118
124—front actuator drive block mounting tube
126—front motor mounting bracket
128—lug of actuator drive block
130—pivot pin connection between lug 128 and bracket 126
132—right rear support link
134—corner mounting bracket connecting 132 to 116
136—pivot pin connecting 132 to right side base rail 106
138—right side front support link
140—pivot pin connecting lower end portion of 138 to right side base rail 106
142—first drive control link
144—corner mounting bracket connecting 142 to 124
146—pivot link
148—pivot pin connecting 146 to 142
150—second drive control link
152—pivot pin connecting 150 to 146
154—pivot pin connecting 150 to 138
156—first footrest actuating link
158—pivot pin connecting 142 to 156
160—second footrest actuating link
162—pivot pin connecting 156 to 160
164—footrest mounting bracket
166—pivot pin connecting 160 to 164
168—third footrest actuating link
170—pivot pin connecting 168 to 164
172—fourth footrest actuating link
174—pivot pin connecting
176—seat rail
178—pivot pin connecting 172 to 176
180—pivot pin interconnecting midpoints of 160 and 172
182—contact stop on 172
184—pivot pin connecting 156 to seat rail 176
186—recline control link
188—pivot pin connecting first corner region of 186 to 138
190—pivot pin connecting second corner region of 186 to 176
192—recline connector link
194—pivot pin connecting 192 to 186
196—recline pivot link
198—pivot pin connecting 192 to 196
200—pivot pin connecting 146 to 176
202—pivot pin connecting 196 to 176
204—seatback support or mounting bracket
206—pivot pin connecting 204 to 176
208—seatback recline link
210—pivot pin connecting 196 to 208
212—pivot pin connecting 208 to 204
214—pivot pin connecting 132 to 196

What is claimed as new and desired to be protected by letters patent of the United States of America, is:

1. A motorized multi-position recliner chair mechanism, comprising:
a base rail;
a footrest support bracket for supporting a footrest;
a seatback support bracket for supporting a seatback;
a seat rail for supporting a seat of said chair;
a rear motor mounting tube;
a drive motor pivotally mounted upon said rear motor mounting tube around a first pivot pin;
a drive motor actuator operatively connected to said drive motor;
an actuator drive block operatively connected to said drive motor actuator;
first linkage operatively connected to said actuator drive block for controlling movement of said footrest support bracket when said actuator drive block is moved in a first direction a first predetermined amount along said drive motor actuator by said drive motor; and
second linkage operatively connected to said actuator drive block for controlling movement of said seatback support bracket when said actuator drive block is moved in said first direction a second predetermined amount along said drive motor actuator by said drive motor;
wherein said rear motor mounting tube is pivotally connected to said base rail around a second pivot pin which is disposed in a coaxial manner with respect to said first pivot pin which pivotally mounts said motor drive upon said rear motor mounting tube such that said drive motor is substantially fixed, or at least positionally constrained, at a predetermined position with respect to said base rail, thereby providing enhanced stability to said chair wherein no asymmetrical moments are developed by and transferred to said base rail as said drive motor under-goes pivotal movements.

2. The mechanism as set forth in claim 1, wherein:
wherein said actuator drive block is pivotally connected to a front actuator drive block mounting tube.

3. The mechanism as set forth in claim 2, wherein:
said first linkage comprises a plurality of footrest actuating links.

4. The mechanism as set forth in claim 3, wherein:
a first drive control link directly connects said front actuator drive block mounting tube to one of said plurality of footrest actuating links such that as said actuator drive block is moved forwardly along said drive motor actuator, said plurality of footrest actuating links will move said footrest support bracket from a closed position to an open position.

5. The mechanism as set forth in claim 4, wherein:
said plurality of footrest actuating links comprises four footrest actuating links.

6. The mechanism as set forth in claim 4, wherein:
said front actuator drive block mounting tube is pivotally connected to said seat rail such that as said actuator drive block is moved forwardly along said drive motor actuator, said seat rail is likewise moved forwardly.

7. The mechanism as set forth in claim 2, wherein:

a front support link is connected at one end portion thereof to said second linkage and is connected at a second opposite end portion thereof to said base rail.

8. The mechanism as set forth in claim 7, wherein:

said second linkage comprises a recline control link which is connected at one end portion thereof to said front support link while a second end portion thereof is connected to said seat rail.

9. The mechanism as set forth in claim 8, wherein:

said second linkage further comprises a pivot link which is operatively connected at a first end portion thereof to said actuator drive block mounting tube and is operatively connected at a second end portion thereof to a first end portion of a second drive control link.

10. The mechanism as set forth in claim 9, wherein:

a second end portion of said second drive control link is operatively connected to said front support link.

11. The mechanism as set forth in claim 8, wherein:

a recline connector link has a first end portion thereof operatively connected to said recline control link and a second opposite end portion thereof operatively connected to a recline pivot link.

12. The mechanism as set forth in claim 11, wherein:

a rear support link has a first end portion thereof operatively connected to said base rail and a second end portion thereof operatively connected to said recline pivot link.

13. The mechanism as set forth in claim 12, further comprising:

a seatback recline link having one end portion thereof operatively connected to said seatback mounting bracket and a second opposite end portion thereof operatively connected to said recline pivot link such that when said recline pivot link is pivoted/rotated, said seatback recline link will cause said seatback to be moved from an upright position to a reclined position.

14. A motorized multi-position recliner chair mechanism, comprising:

a rear base rail;

a footrest support bracket for supporting a footrest;

a seatback support bracket for supporting a seatback;

a seat rail for supporting a seat of said chair;

a drive motor operatively connected to said rear base rail such that said drive motor is substantially fixed, or at least positionally constrained, at a predetermined position with respect to said rear base rail thereby providing enhanced stability to said chair wherein no asymmetrical moments are developed by and transferred to said base rail as said drive motor undergoes pivotal movements;

a drive motor actuator operatively connected to said drive motor;

an actuator drive block operatively connected to said drive motor actuator, wherein said actuator drive block is pivotally connected to a front actuator drive block mounting tube;

first linkage, comprising a plurality of footrest actuating links, operatively connected to said actuator drive block for controlling the movement of said footrest support bracket when said actuator drive block is moved along said drive motor actuator by said drive motor; and second linkage operatively connected to said actuator drive block for controlling the movement of said seatback support bracket when said actuator drive block is moved along said drive motor actuator by said drive motor; and wherein said first linkage comprises a first drive control link which directly connects said front actuator drive block mounting tube to one of said plurality of footrest actuating links such that as said actuator drive block is moved forwardly along said drive motor actuator, said plurality of footrest actuating links will move said footrest support bracket from a closed position to an open position.

15. The mechanism as set forth in claim 14, wherein:

said front actuator drive block mounting tube is pivotally connected to said seat rail such that as said actuator drive block is moved forwardly along said drive motor actuator, said seat rail is likewise moved forwardly.

16. The mechanism as set forth in claim 14, wherein:

a front support link is connected at one end portion thereof to said second linkage and is connected at a second opposite end portion thereof to said base rail.

17. The mechanism as set forth in claim 16, wherein:

said second linkage comprises a recline control link which is connected at one end portion thereof to said front support link while a second end portion thereof is connected to said seat rail.

18. The mechanism as set forth in claim 17, wherein:

said second linkage further comprises a pivot link which is operatively connected at a first end portion thereof to said actuator drive block mounting tube and is operatively connected at a second end portion thereof to a first end portion of a second drive control link.

19. The mechanism as set forth in claim 18, wherein:

a second end portion of said second drive control link is operatively connected to said front support link.

20. The mechanism as set forth in claim 14, wherein:

said plurality of footrest actuating links comprises four footrest actuating links.

* * * * *